US008905050B2

(12) United States Patent
Gueret

(10) Patent No.: US 8,905,050 B2
(45) Date of Patent: Dec. 9, 2014

(54) APPLICATOR FOR APPLYING A COMPOSITION TO THE EYELASHES OR THE EYEBROWS

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 13/387,005

(22) PCT Filed: Jul. 30, 2010

(86) PCT No.: PCT/IB2010/053469

§ 371 (c)(1),
(2), (4) Date: Mar. 16, 2012

(87) PCT Pub. No.: WO2011/013098

PCT Pub. Date: Feb. 3, 2011

(65) Prior Publication Data

US 2012/0174941 A1 Jul. 12, 2012

Related U.S. Application Data

(60) Provisional application No. 61/236,909, filed on Aug. 26, 2009.

(30) Foreign Application Priority Data

Jul. 31, 2009 (FR) ..... 09 55436

(51) Int. Cl.

| | |
|---|---|
| ***A45D 40/26*** | (2006.01) |
| ***A46B 9/02*** | (2006.01) |
| ***A46D 1/00*** | (2006.01) |
| ***A46D 9/00*** | (2006.01) |

(52) U.S. Cl.

CPC . *A46D 9/00* (2013.01); *A46B 9/021* (2013.01); *A46B 9/028* (2013.01); *A46D 1/0253* (2013.01); *A46D 1/0284* (2013.01); *A46B 2200/1053* (2013.01); *A45D 40/265* (2013.01)

USPC ..... 132/218; 300/21

(58) Field of Classification Search

USPC ..... 132/218, 320; 15/160, 206, 207.2, 15/DIG. 5, DIG. 6; 300/21

See application file for complete search history.

(56) References Cited

U.S. PATENT DOCUMENTS 5,020,551 A * 6/1991 Guerret ..... 132/200
5,197,497 A 3/1993 Gueret (Continued)

FOREIGN PATENT DOCUMENTS

EP 0 486 329 A1 5/1992
EP 0 568 400 A1 11/1993

(Continued)

OTHER PUBLICATIONS

International Search Report issued in International Application No. PCT/IB2010/053469 dated Nov. 3, 2010.

(Continued)

*Primary Examiner* — Rachel Steitz
(74) *Attorney, Agent, or Firm* — Oliff PLC

(57) ABSTRACT

An applicator for applying a cosmetic composition to the eyelashes or the eyebrows, the applicator having an applicator member having a core; and applicator elements that extend from the core, having ends that define an envelope surface, the applicator elements including first and second applicator elements; the first applicator elements having free ends that are wide relative to the free ends of the second applicator elements having a maximum length that is greater than the maximum length of the first applicator elements; the envelope surface having a non-circular cross-section over at least a fraction of the length of the applicator member, or presenting at least two disjoint portions that are defined by the first applicator, elements.

24 Claims, 3 Drawing Sheets

(56) References Cited

U.S. PATENT DOCUMENTS

| | | | | |
|---|---|---|---|---|
| 5,345,644 | A | 9/1994 | Gueret | |
| 5,542,439 | A | 8/1996 | Gueret | |
| 2002/0020426 | A1 * | 2/2002 | Gueret | 132/218 |
| 2005/0257802 | A1 | 11/2005 | Yasuda | |
| 2007/0204873 | A1 | 9/2007 | Kim | |
| 2007/0204874 | A1 | 9/2007 | Kim | |

FOREIGN PATENT DOCUMENTS

| | | | |
|---|---|---|---|
| EP | 0 663 161 | A1 | 7/1995 |
| EP | 1 475 013 | A1 | 11/2004 |
| FR | 2 916 328 | A1 | 11/2008 |
| JP | A-05-228018 | | 9/1993 |

OTHER PUBLICATIONS

Written Opinion issued in International Application No. PCT/IB2010/053469 dated Nov. 3, 2010.

Preliminary Search Report issued in French Patent Application No. 0955436 dated Mar. 16, 2010 (with translation).

* cited by examiner

APPLICATOR FOR APPLYING A COMPOSITION TO THE EYELASHES OR THE EYEBROWS

The present invention relates to applicator devices for applying a cosmetic, makeup, or care-product composition to human keratinous fibers, and more particularly to the eyelashes or the eyebrows.

It is known to subject a twisted-core brush to different treatments while the bristles are in place on the core, so as to change the characteristics of the brush.

European patent EP 0 486 329 thus discloses a method in which balls are formed at the ends of the bristles by locally melting material.

European patent application EP 0 568 400 discloses brushes comprising bristles having different melting temperatures. The need to select such specific bristles may impose manufacturing constraints and may reduce the variety of brushes that can be manufactured.

There exists a need to improve still further applicators for applying a cosmetic composition to human keratinous fibers, in particular so as to broaden possibilities still further in terms of applying composition to the fibers.

First exemplary embodiments of the invention thus provide an applicator for applying a cosmetic composition to the eyelashes or the eyebrows, the applicator comprising:

an applicator member comprising:

a core; and applicator elements that extend from the core, having ends that define an envelope surface, the applicator elements comprising first applicator elements and second applicator elements, the first applicator elements having free ends that are wide relative to the free ends of the second applicator elements.

The term "free end" should be understood to mean the end portion remote from the core.

Whatever the shape of the second applicator elements, the first applicator elements may have an enlarged free end (also defined as wide end).

The expression "enlarged free end" means that the transverse dimension of the applicator element increases towards its free end on at least a fraction of the length of its end portion.

For example, the first applicator elements include a protuberance, in particular formed by melting, at their end, such as a ball, and the second applicator elements do not have such a protuberance, and, by way of example, present a section that is constant from mid-way along their length to their tip.

The applicator member may comprise, over at least a fraction of the part of the core carrying the applicator elements, second applicator elements that are deprived of enlarged free end.

The "part of the core carrying the applicator elements" is defined between the bases of the extreme applicator elements that are respectively the applicator element closest to the distal end and the applicator element closest to the proximal end of the applicator member.

According to an exemplary embodiment, the applicator member may comprise, in the median part of the part of the core carrying the applicator elements, second applicator elements that are deprived of enlarged free end.

The term "median part of the part of the core carrying the applicator elements" corresponds to the part of the core which longitudinally extends between the abscissas situated at 25% and 75% of the total length of the part of the core carrying the applicator elements.

The second applicator elements have a maximum length (i.e. the length of the longest of the second applicator elements) that is greater than the maximum length of the first applicator elements (i.e. the length of the longest of the first applicator elements).

By means of the wide ends, the invention makes it possible to obtain an applicator member with at least one recessed loading face, and with at least one separating portion, in particular a separating edge, by means of the applicator elements that do not have such wide ends, but have ends that are smooth, for example.

The envelope surface may be of non-circular cross-section over at least a fraction of the length of the applicator member.

The envelope surface may present at least two disjoint portions that are defined by the first applicator elements. The two disjoint portions may follow each other along the longitudinal axis of the core, or they may occupy overlapping axial positions, but be disposed angularly in such a manner as to be disjoint.

The first and second applicator elements may extend around the core in distinct angular sectors, over at least a fraction of the length of the applicator member.

In cross-section and over at least a fraction of its length, the applicator member may include one or more sectors of greater radius, the first applicator elements not being in said sector(s). All of the bristles of at least one of the sectors, e.g. all of the sectors, may be longer than the bristles that include wide ends.

The wide ends are formed by melting the ends of the applicator elements. The melting operation may simultaneously form the wide ends and give the envelope surface all or some of its final shape. It is possible to give the envelope surface of the applicator member shapes that are otherwise difficult to obtain, combined with variations in the characteristics of the application surface that other techniques of manufacturing or treating the applicator members do not make it possible to obtain.

By means of the invention, novel shapes of envelope surface associated with applicator elements may be made, locally presenting different properties as a result of the presence or absence of protuberances at their ends.

In particular, it is possible to make the applicator member with a view to use the first applicator elements, including wide ends, in order to retain more composition and thus load the eyelashes more, and to use the second applicator elements in order to penetrate more easily between the eyelashes and to separate them.

In selecting the shape of the portions defined by the first applicator elements each having a wide end, it is possible to adjust the capacity of the applicator member to separate the eyelashes, and to adjust its ability to load the eyelashes.

All of the second applicator elements may possibly be of length that is longer than all of the first applicator elements.

The first applicator elements may define at least one hollow portion in the envelope surface.

The number of first applicator elements may represent 5% to 90%, or even 5% to 80% of the total number of applicator elements, better 10% to 50%.

In other words, the free ends of the applicator elements defining the envelope surface of the applicator member may include at least 5% of wide ends.

The applicator may include, in particular over one or more segments only of the applicator member or over its entire length, a single connected angular sector around the core that contains all of the first applicator elements.

The applicator may include, in particular over one or more segments of the applicator member or over its entire length, a plurality of first disjoint angular sectors containing only the first applicator elements alternating with second disjoint angular sectors containing only the second applicator elements.

The first and second sectors may alternate in the longitudinal direction along the applicator member. The first and second sectors may equally well alternate in the circumferential direction.

The second applicator elements may define at least one projecting portion of the envelope surface.

The first and/or second applicator elements may comprise applicator elements made of different materials and/or having different cross-sections, in particular having different diameters.

The first and second applicator elements may have a same melting temperature. The first and second applicator elements may, in particular, be made of a same material.

The offset between $l_{2max}$ and $l_{1max}$ may be greater than or equal to 0.5 millimeters (mm), better greater than or equal to 1 mm.

The core may be a twisted core, and the applicator elements may be bristles that are held between the turns of the core. The applicator elements may equally well be molded integrally with the core.

According to another exemplary embodiment, the invention provides an applicator for applying a cosmetic composition to the eyelashes or the eyebrows, the applicator comprising:

an applicator member comprising:

a core; and applicator elements that extend from the core, having ends that define an envelope surface, the applicator elements comprising:

first applicator elements; and second applicator elements; the first applicator elements having free ends that are wide relative to the free ends of the second applicator elements, the second applicator elements having a maximum length $l_{2max}$ that is greater than the maximum length $l_{1max}$ of the first applicator elements;

the envelope surface being of non-circular cross-section over at least a fraction of the length of the applicator member.

According to another exemplary embodiment, the invention provides an applicator for applying a cosmetic composition to the eyelashes or the eyebrows, the applicator comprising:

an applicator member comprising:

a core and applicator elements that extend from the core, having ends that define an envelope surface, the applicator elements being molded integrally with the core and comprising:

first applicator elements; and second applicator elements; the first applicator elements having free ends that are wide relative to the free ends of the second applicator elements, the second applicator elements having a maximum length $l_{2max}$ that is greater than the maximum length $l_{1max}$ of the first applicator elements ;

the envelope surface being of non-circular cross-section over at least a fraction of the length of the applicator member, or presenting at least two disjoint portions that are defined by the first applicator elements.

The invention also provides a method of manufacturing an applicator including an applicator member comprising a core and applicator elements that extend from the core, in particular an applicator as defined above, wherein a tool is moved towards the applicator elements in such a manner as to melt the ends of the applicator elements and change the shape of the envelope surface of the applicator member, so as to impart thereto a non-circular cross-section over at least a fraction of its length, or so as to form at least two disjoint portions that are defined by the applicator elements having ends that have been melted.

The tool may include an infrared heat source, a hot-air source, or a portion that is heated and brought into contact with the applicator elements, e.g. a portion that is made of metal, glass, or ceramic.

Before the shape of the envelope surface is changed, all of the applicator elements have the same diameter, e.g. lying in the range 6/100 mm to 40/100 mm.

Before the applicator elements are melted, the applicator member may present an envelope surface that is circularly symmetrical. A sector of the applicator member of less than 360° around its axis may be treated. It is possible to treat only one segment of the applicator member, over 360° or less.

The applicator member may be treated by bringing the heater member into contact with the applicator elements only once, or by bringing it into contact with the applicator elements more than once.

A plurality of heater members may be used simultaneously to treat a plurality of distinct portions of the envelope surface simultaneously.

The treatment may change the envelope surface by causing it to retract towards the core, e.g. through a distance of at least 0.5 mm in places, or even through at least 1 mm.

The use of applicator elements of different sizes or sections, in particular of different diameters, and/or made of different materials, makes it possible to obtain applicator elements of different heights after forming wide ends and/or different-sized wide ends.

The invention can be better understood on reading the following detailed description of non-limiting embodiments thereof, and on examining the accompanying drawings, in which.

Figure 1:
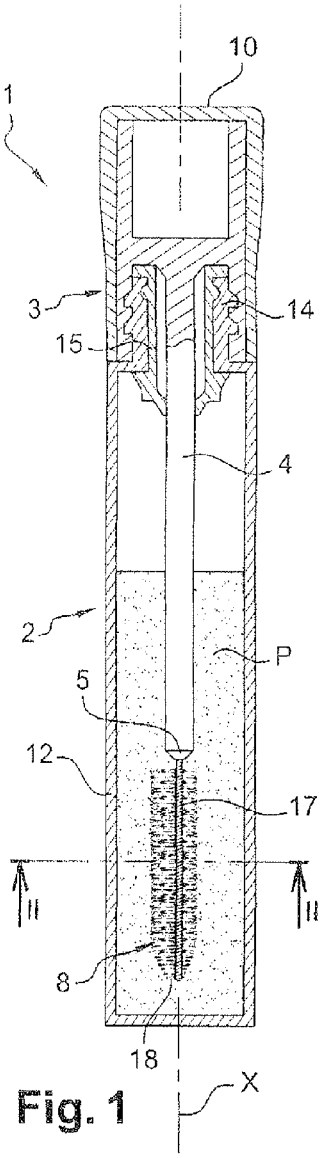
FIG. 1 is a diagrammatic and fragmentary longitudinal section showing an example of a packaging and applicator device made in accordance with the invention.

The packaging and applicator device 1 shown in FIG. 1 comprises: a receptacle 2 containing a composition P for application to the eyelashes or the eyebrows; and an applicator 3 comprising a stem 4 that is provided at one end 5 with an applicator member 8 made in accordance with the invention, and that is provided at the other end with a handle 10 that, as shown, may also constitute, a closure member for closing the container 2. As shown, the container may be made with a body 12 that is open at one end, and that includes a neck 14 in which there is present a wiper member 15 that may be of any known type.

In a variant not shown, the handle 10 does not close a container.

The container 2 may be made by molding a thermoplastic material.

As shown, the applicator member 8 may be constituted by a twisted-core brush comprising a core 17 that is formed of two lengths of twisted-together wire that hold applicator elements 18, also known as bristles, between the turns. By way of example, the lengths of wire are obtained by folding a wire in half to form a U-shape, e.g. a wire of diameter lying in the range 0.35 mm to 0.9 mm.

Figure 4:
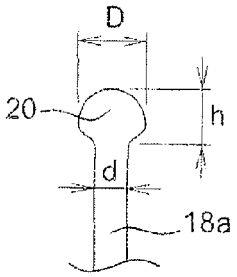
FIG. 4 is an elevation view showing the end portion of an applicator element of the FIG. 1 applicator member, provided with a wide end.
Figure 5:
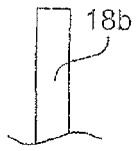
FIG. 5 shows the end of another applicator member, without widening at its end.

In exemplary embodiments of the invention, the applicator elements 18 are made up of at least two categories, namely first applicator elements 18*a*, each provided with a wide portion 20 at its end, as shown in FIG. 4, and second applicator elements 18*b* that are not provided with wide portions at their ends, as shown FIG. 5.

The free ends of the longest applicator elements 18 locally define an envelope surface E that, over at least a fraction of the length of the applicator member 8, presents a cross-section that is not circular.

The envelope surface may optionally be symmetrical about a mid-plane containing the longitudinal axis of the core, and may optionally be axially-symmetrical.

Figure 2:
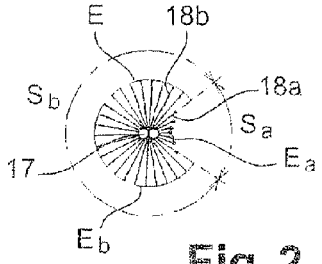
FIG. 2 is a cross-section of the applicator member on II-II in FIG. 1.

In the embodiment in FIG. 2, over at least a fraction of the length of the brush, the envelope surface E is thus formed by a portion $E_b$ of outline that is circular in section combined with a portion $E_a$ of outline that is concave in section.

By way of example, each wide portion 20 presents a greatest transverse dimension D, in particular a diameter that is greater than or equal to 1.2d for example, where d designates the greatest transverse dimension below the wide portion. By way of example, D≥1.5d. In particular exemplary embodiments, it is possible to have a wide portion with a diameter of 1.5 mm made from a bristle with a diameter of 17/100 mm.

In general, the axial dimension h of a wide portion 20 lies in the range 0.2 mm to 2 mm.

The dimension h may be less than 10% of the total length of the applicator element 18*a*, measured between the core and its free end.

Below the wide portion 20, the section of an applicator element 18*a* is constant or it may vary periodically.

By way of example, an applicator element 18 is of solid circular cross-section below the wide portion 20, e.g. of diameter lying in the range 0.6/100 mm to 40/100 mm.

Figure 8:
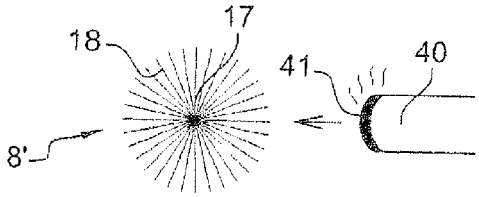
FIG. 8 shows a method of treating an applicator member blank in accordance with the invention.

In order to give the envelope surface E of the applicator member 8 its final shape, at least one heater member 40 may be brought into contact with the applicator elements 18 of a blank 8', as shown in FIG. 8, which heater member is raised to a temperature that is greater than the melting temperature of the material out of which the applicator elements 18 are made. The applicator elements melt on contact with a surface 41 of the heater member 40, forming the wide portions 20.

While the heater member 40 and the applicator-member blank 8' are being moved towards each other, the applicator-member blank need not turn relative to the heater member 40, about the longitudinal axis of the core 17.

Figure 3A:
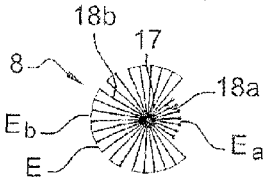
FIGS. 3A to 3G are views similar to FIG. 2 of variant embodiments of the applicator member.

The envelope surface E may have a very wide variety of shapes, e.g. the portion $E_a$ defined by the applicator elements 18*a*, each including a wide portion 20, may extend as a circularly-cylindrical portion of axis X, as shown in FIG. 3A, that may have the same axis as the envelope surface portion $E_b$ that is defined by the applicator elements 18*b*, while being of smaller diameter.

Figure 9A:
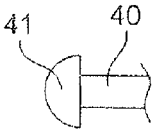
FIGS. 9A to 9F show examples of tools that are suitable for being used to treat an applicator member blank.
Figure 9B:
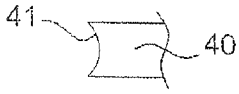

By way of example, the envelope surface portion $E_a$ is formed by moving a heater member 40 towards the applicator elements 18, which heater member has a hot surface 41 that is outwardly concave, as shown in FIG. 9B.

In the circumferential direction, the applicator member 8 may include alternating sectors $S_a$ and $S_b$, with the sectors $S_a$ including applicator elements 18*a* only, and sectors $S_b$ including applicator elements 18*b* only. By way of example, a sector $S_a$ extends angularly over at least 10° around the longitudinal axis of the core.

Figure 3B:
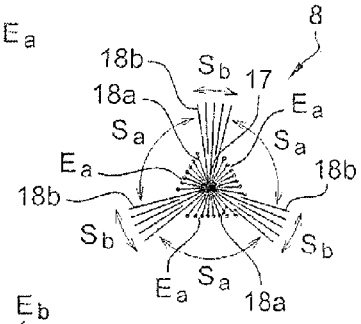

FIG. 3B shows an applicator member 8 in such exemplary embodiments of the invention.

It can be seen that the sectors formed by the applicator elements 18*b* may project relative to the other sectors formed by the elements 18*a*, the applicator elements 18*b* comprising applicator elements having a maximum length $l_{2max}$ that is greater than the maximum length $l_{1max}$ of the applicator elements 18*a*.

Figure 3C:
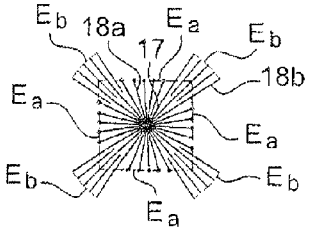

One or more ridges may thus be defined on the applicator member 8, e.g. disposed at the vertices of a triangle, as shown in FIG. 3B, or of a square, as shown in FIG. 3C.

The portions $E_a$ of the envelope surface E, as defined by the applicator elements 18*a*, may be plane, e.g. parallel to the longitudinal axis of the applicator member and perpendicular to the bisector of each sector $S_a$.

Figure 9C:
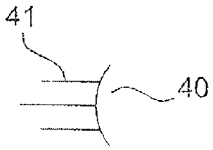
Figure 9D:
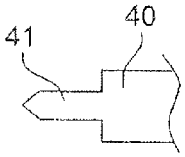
Figure 9E:
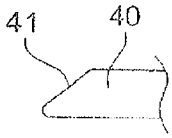
Figure 9F:
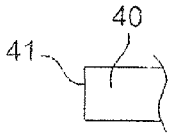

By way of example, the portions $E_a$ may be formed using a heater member 40 such as that shown in FIG. 9F, having a hot surface 41 that is plane.

By way of example, the portions $E_b$ of the envelope surface E are portions of a circular cylinder, forming parts of the cylindrical envelope 8' of the blank from which the applicator member 8 is made.

Figure 3D:
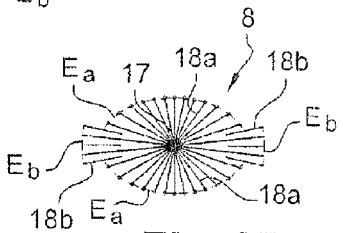

The portion(s) $E_a$ defined by the applicator elements 18*a* may generally be outwardly convex, as shown in FIG. 3D, and, by way of example, may present an outline that is not circular in cross-section, e.g. that is elliptical, as shown in this figure.

In the example shown in FIG. 3D, the applicator member 8 includes two opposite portions $E_a$ of the envelope surface that is defined by the applicator elements 18*a* with wide ends 20, and between the two portions $E_a$, it includes longer applicator elements 18*b* that are not widened at their ends.

Figure 3E:
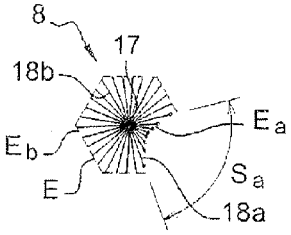

FIG. 3E shows the possibility of the envelope surface E being of cross-section that is polygonal, e.g. hexagonal, at least in part.

The portion $E_a$ may be concave and may extend angularly around the longitudinal axis of the core over an angular extent $S_a$ that is greater than the angular extent of a side of the polygon. The portion $E_b$ may be obtained by machining a blank having a circularly cylindrical envelope surface, either before forming the envelope surface portion $E_a$, or after forming said envelope surface portion $E_a$.

Figure 3F:
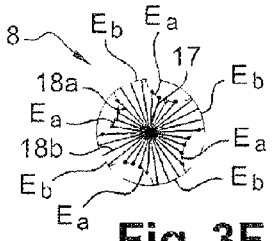

FIG. 3F shows an applicator member 8 that includes a plurality of hollow envelope surface portions $E_a$ that are defined by applicator elements 18*a* with widened ends 20, and that are separated by envelope surface portions $E_b$ in which the free ends of the applicator elements are situated on a single circle that is centered on the longitudinal axis X of the core 17.

Figure 3G:
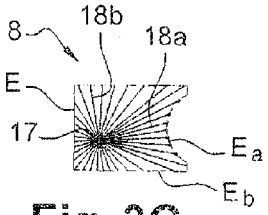

In general, the blank that is used to make an applicator member of the invention by melting the applicator elements in part may have a cross-section of any shape that may be circular or non-circular, that may be centered or off-center, and that may be provided with one or more notches, ridges, facets, or slots. FIG. 3G shows an example of an off-center core 17.

Before or after the step of forming the applicator elements 18*a*, the core 17 of the applicator member 8 may be rectilinear or non-rectilinear. After the applicator elements 18*a* have been formed, the shape of the core 17 may be non-rectilinear.

The free end of the core 17 may optionally be situated on the longitudinal axis X of the stem 4. The wide portion 20 may present the general shape of a ball, as shown in FIG. 4.

Figure 6A:
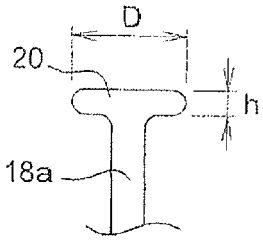
FIGS. 6A to 6E are views similar to FIG. 4 of variant embodiments of applicator elements.
Figure 6B:
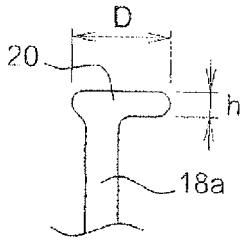

In variants, and in particular as a function of the heater tool used, e.g. of its temperature and of the shape of its surface, flatter wide portions 20 may be formed, as shown in FIG. 6A, that may optionally be circularly-symmetrical about the longitudinal axis of the applicator element 18*a*, and in particular may be off-center relative to the long direction of the applicator element, as shown in FIG. 6B.

Figure 6C:
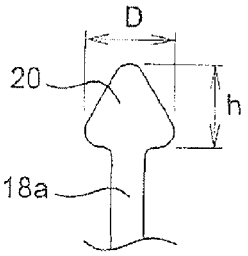
Figure 6D:
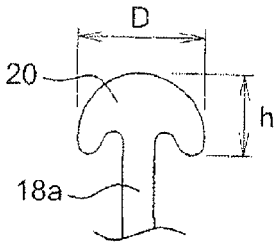
Figure 6E:
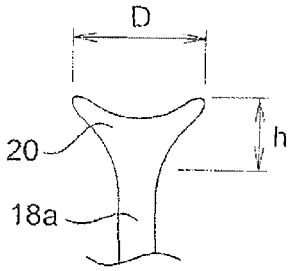

The wide portion 20 may present a general shape that tapers towards the free end of the applicator element 18*a*, as shown in FIG. 6C.

Where appropriate, the wide portion 20 may include one or more rims that are directed back towards the base of the applicator element 18*a*, as shown in FIG. 6D.

Where appropriate, the wide portion 20 may present an end that is outwardly-concave, as shown in FIG. 6E.

The applicator elements 18*a* may be formed from applicator elements 18 that are identical, e.g. bristles of the same diameter, made of the same material, and of the same section. Before the wide portions 20 are formed, the applicator elements 18*b* may be identical to the applicator elements 18*a*.

Figure 7:
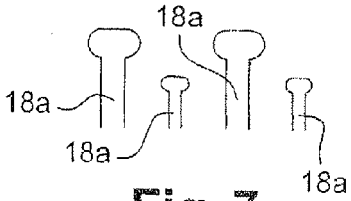
FIG. 7 shows the possibility of having applicator elements of different cross-sections, each having a wide end portion.

In a variant, a mixture of different bristles, e.g. of different diameters, may be used to make the applicator elements 18*a*. By way of example, after partial melting and forming wide ends 20, this makes it possible to obtain applicator elements 18*a* having different lengths, e.g. while being heated, the bristles of smaller section may retract more than the thicker bristles, as shown in FIG. 7.

The tool that is used to melt the applicator elements in part so as to form the wide portions 20 at their ends may present various shapes, some of which are described above.

In particular, the tool 40 may present a heating surface 41 that is outwardly-convex, as shown in FIG. 9A.

The tool 40 may also include a heating surface that is defined by spaced-apart points, as shown in FIG. 9C.

FIG. 9D shows the possibility of making the heating surface 41 with a tapering shape, and FIG. 9E with a beveled shape.

The heating surface 41 may be heated by conduction, the heater member 40 being made out of a heat-conductive material such as steel or any other metal. The heat may be produced by a flow of hot fluid, by combustion, or by the Joule effect. Alternatively, infrared radiation, light radiation, ultrasound, or microwaves may be used to melt the ends of the bristles.

Figure 10A:
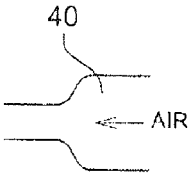
FIGS. 10A to 10D show other examples of tools that are suitable for being used to treat an applicator member blank.
Figure 10B:
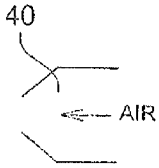
Figure 10C:
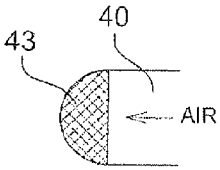

The heater member 40 may also include a hot-air outlet nozzle, as shown in FIGS. 10A to 10C, the nozzle possibly presenting different profiles as shown in the figures, e.g. having an end that is straight, as shown in FIG. 10A, or converging, as shown in FIG. 10B, or provided with a mesh 43, as shown in FIG. 10C.

Figure 10D:
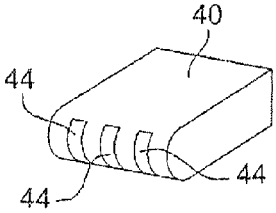

The heater member 40 may also be made with a plurality of slots 44, as shown in FIG. 10D, e.g. for treating a plurality of segments that are spaced apart along the blank of the applicator member.

Figure 11:
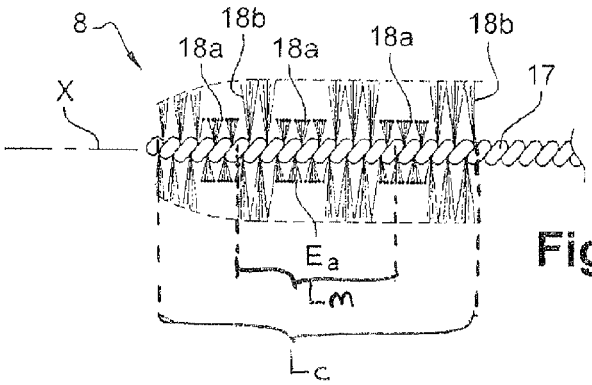
FIG. 11 shows an applicator member in isolation and made in accordance with a variant embodiment of the invention.

A plurality of portions of the applicator member that are spaced apart along the longitudinal axis X may be treated by heating, as shown in FIG. 11. By way of example, each treated portion extends all around the axis X, or through a limited angular sector around the axis X.

FIG. 11 further shows the part $L_c$ of the core carrying the applicator elements and the median part of the part $L_m$ of the core carrying the applicator elements. As shown in FIG. 11, the applicator member may comprise, in the median part of the part of the core carrying the applicator elements, second applicator elements that are deprived of wide end.

Figure 12:
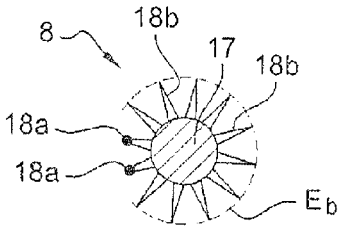
FIG. 12 is a cross-section of an applicator member in another embodiment of the invention.

The invention is not limited to treating twisted-core brushes, and the applicator member may alternatively be made by molding one or more materials, as shown in FIG. 12.

One or more longitudinal rows may be treated over their entire length or over a fraction of their length.

All of the characteristics of the embodiments described above, in connection with twisted-core brushes, also apply to applicator members made by molding, and for hybrid applicator members in which the applicator elements are fitted onto a core and fastened thereto, e.g. by embedding, and applicator members including some applicator elements that are supported by a twisted core and others that are supported by a molded core.

As such, the first and second applicator elements may be bristles, the core being or not a twisted core.

In addition to the treatment of melting the bristles, other treatments may be applied, e.g. grinding the longest applicator elements, in particular when said applicator elements do not include projections at their ends.

At least some applicator elements may also be curved while hot, as described in US patent No. 2004-01 68698, or beaten, as described in U.S. Pat. No. 7,125,188.

The applicator member may be flocked, magnetic, or magnetizable, include at least one biocidal agent, e.g. an antibacterial agent, in particular a preservative.

The core may have a longitudinal axis that is rectilinear or curved, or may possibly have both a rectilinear portion and a curved portion, e.g. a curved portion situated at the connection with a support stem of the applicator member.

The invention is not limited to the embodiments described above. The characteristics of the various embodiments shown can be combined together within variants not shown.

The second applicator elements need not have wide ends. In a variant, and where appropriate, the second applicator elements may present wide ends of section smaller than the wide ends of the first applicator elements. By way of example, and in contrast to the first applicator elements, such a widening of the second applicator elements need not have been obtained by means of a melting process.

The expression "comprising a" should be understood as being synonymous with "comprising at least one" unless specified to the contrary.

The invention claimed is:

1. An applicator for applying a cosmetic composition to eyelashes or eyebrows, the applicator comprising:

an applicator member, including:

a core; and applicator elements that extend from the core, the applicator elements having ends that define an envelope surface, the applicator elements including:

first applicator elements having enlarged free ends; and second applicator elements having free ends that are not enlarged, and are of constant cross-section from the core to the free ends of the second applicator elements; wherein:

the enlarged free ends of the first applicator elements are wide relative to the free ends of the second applicator elements;

the second applicator elements have a maximum length ($l_{2max}$) that is greater than a maximum length ($l_{lmax}$) of the first applicator elements; and the envelope surface has a non-circular cross-section over at least a fraction of a length of the applicator member, the first applicator elements defining at least one hollow portion in the envelope surface in cross-section.

2. The applicator according to claim 1, the second applicator elements extending, over at least a fraction of the length of the applicator member, around the core in at least one sector in which the first applicator elements are not present.

3. The applicator according to claim 1, the enlarged free ends being formed by melting the ends of the first applicator elements.

4. The applicator according to claim 3, the first and the second applicator elements being identical before the melting.

5. The applicator according to claim 1, including a single connected angular sector around the core that contains all of the first applicator elements.

6. The applicator according to claim 1, the second applicator elements defining at least one projecting portion of the envelope surface.

7. The applicator according to claim 1, the first applicator elements comprising applicator elements made of different materials and/or having different cross-sections.

8. The applicator according to claim 1, an offset between $l_{2max}$ and $l_{1max}$ being greater than or equal to 0.5 mm.

9. The applicator according to claim 1, the applicator elements being bristles.

10. The applicator according claim 9, the core being a twisted core, and the applicator elements being bristles that are held between the turns of the core.

11. The applicator according to claim 1, the applicator elements being molded integrally with the core.

12. The applicator according to claim 1, the free ends of the applicator elements defining the envelope surface of the applicator member including at least 5% of enlarged free ends.

13. The applicator according to claim 1, the first and second applicator elements having a same melting temperature.

14. The applicator according to claim 13, the first and second applicator elements being made of a same material.

15. The applicator according to claim 1, wherein the applicator member comprises second applicator elements in a median part $L_m$ of a part of the core carrying the applicator elements.

16. A method of manufacturing the applicator of claim 1, the method comprising:

moving a tool towards the applicator elements in such a manner as to melt the ends of the applicator elements and change the shape of the envelope surface of the applicator member, so as to impart thereto a non-circular cross-section over at least a fraction of its length.

17. The method according to claim 16, wherein the tool is brought into contact with the applicator elements during the melting step.

18. The method according to claim 16, wherein only the free ends of the first applicator elements are melted.

19. The applicator according to claim 1, the first applicator elements being located between the second applicator elements.

20. An applicator for applying a cosmetic composition to eyelashes or eyebrows, the applicator comprising:

an applicator member, including:

a core; and applicator elements that extend from the core, the applicator elements having ends that define an envelope surface, the applicator elements comprising:

first applicator elements having enlarged free ends; and second applicator elements having free ends that are not enlarged, and are of constant cross-section from the core to the free ends of the second applicator elements; wherein:

the enlarged free ends of the first applicator elements are wide relative to the free ends of the second applicator elements;

the second applicator elements have a maximum length ($l_{2max}$) that is greater than a maximum length ($l_{1max}$) of the first applicator elements; and the envelope surface includes a plurality of first disjoint angular sectors containing only a plurality of the first applicator elements, alternating with second angular sectors containing only a plurality of the second applicator elements.

21. The applicator according to claim 20, the first and second sectors alternating in a longitudinal direction along the applicator member.

22. The applicator according to claim 20, the first and second sectors alternating in a circumferential direction.

23. A method of manufacturing the applicator of claim 20, the method comprising:

moving a tool towards the applicator elements in such a manner as to melt the ends of the applicator elements and change the shape of the envelope surface of the applicator member, so as to form at least two disjoint portions that are each defined by the applicator elements having ends that have been melted by said tool.

24. An applicator for applying a cosmetic composition to eyelashes or eyebrows, the applicator comprising:

an applicator member, including:

a core; and applicator elements that extend from the core, the applicator elements having ends that define an envelope surface, the applicator elements including:

first applicator elements having enlarged free ends; and second applicator elements having free ends that are not enlarged, and that do not have wide portions;

wherein:

the enlarged free ends of the first applicator elements are wide relative to the free ends of the second applicator elements, and the second applicator elements have a maximum length ($l^1_{2max}$) that is greater than a maximum length ($l_{1max}$) of the first applicator elements; and the envelope surface has a non-circular cross-section over at least a fraction of a length of the applicator member wherein the first applicator elements define at least one hollow portion in the envelope surface in cross-section, or the envelope surface includes a plurality of first disjoint angular sectors containing only a plurality of the first applicator elements. alternating with the second angular sectors containing only a plurality of the second applicator elements.

* * * * *